United States Patent [19]

Ackley

[11] Patent Number: 4,672,892

[45] Date of Patent: Jun. 16, 1987

[54] APPARATUS FOR CONVEYING AND MARKING PELLET-SHAPED ARTICLES

[76] Inventor: E. Michael Ackley, 1273 N. Church St., Moorestown, N.J. 08057

[21] Appl. No.: 734,933

[22] Filed: May 16, 1985

Related U.S. Application Data

[63] Continuation-in-part of Ser. No. 395,926, Jul. 7, 1982, abandoned, and a continuation-in-part of Ser. No. 544,509, Oct. 24, 1983, Pat. No. 4,528,904.

[51] Int. Cl.[4] ..... B41F 17/36

[52] U.S. Cl. ..... 101/35; 198/397

[58] Field of Search ..... 101/40, 35, 36, 37, 101/38 A, 39, 38 R; 198/397, 803.5, 803.14

[56] References Cited

U.S. PATENT DOCUMENTS

| | | | |
|---|---|---|---|
| 2,859,689 | 11/1958 | Ackley | 101/35 |
| 3,272,118 | 9/1966 | Ackley | 101/37 |
| 3,545,164 | 12/1970 | Middleton | 53/26 |
| 3,581,377 | 6/1971 | McKnight | 29/427 |
| 3,685,441 | 8/1972 | Aebersold et al. | 101/38 A |
| 3,889,591 | 6/1975 | Noguchi | 101/37 |
| 4,092,949 | 6/1978 | Balordi | 101/40 X |
| 4,193,343 | 3/1980 | Ackley, Sr. et al. | 101/154 X |
| 4,266,478 | 5/1981 | Ackley | 101/40 |
| 4,308,942 | 1/1982 | Ackley | 101/40 X |
| 4,528,904 | 7/1985 | Ackley | 101/35 |

*Primary Examiner*—Clifford D. Crowder

*Attorney, Agent, or Firm*—Weiser & Stapler

[57] ABSTRACT

An article marking apparatus which generally includes a transfer drum for receiving a series of articles from a feed hopper, for transfer to a conveyor system, and a pair of printing heads associated with the article marking apparatus at different locations along the path through which the articles progress. One printing head is positioned along the arcuate transfer path developed as the articles progress about the transfer drum, so as to apply indicia to one side of the articles being processed as they traverse the transfer drum. The other printing head is positioned along the conveyor system, so as to apply indicia to the other side of the articles being processed as they traverse the conveyor system. As a result, indicia are capable of being applied to both sides of the articles being processed in a single processing operation.

To permit the application of indicia to different types of articles with a minimum amount of set-up and readjustment, the transfer drum preferably incorporates series of laterally spaced, yet differently configured rows of article receiving cavities; and a vacuum shoe which is capable of variable positioning along the inner face of the transfer drum so as to select the rows or groupings of rows of cavities which are to be called into operation, and accordingly, the type of articles which are to be processed.

40 Claims, 8 Drawing Figures

1
2
3
4
5
6
11
12
13
18
20
21
22
27
30
58
59

APPARATUS FOR CONVEYING AND MARKING PELLET-SHAPED ARTICLES

CROSS-REFERENCE TO RELATED APPLICATIONS

The present application is a continuation-in-part of co-pending U.S. patent application Ser. No. 395,926, filed July 7, 1982 since abandoned, and entitled "Pharmaceutical Tablet Processing Apparatus"; and of co-pending U.S. patent application Ser. No. 544,509, filed Oct. 24, 1983, and entitled "Article Marking Apparatus", now U.S. Pat. No. 4,528,904, dated July 16, 1985.

BACKGROUND OF THE INVENTION

The present invention generally relates to the application of indicia to various articles, and in particular, to an apparatus which facilitates the application of indicia to multi-sided articles in a single printing operation.

A variety of articles such as candies, pharmaceutical capsules, tablets and the like, and other pellet shapes, are often marked with identifying indicia. These markings may include various indicia such as trademarks, lot number, manufacturer/company name, etc. A variety of different devices have been developed to accomplish this task.

One device which has found utility in the application of indicia to various pellet shaped articles, especially pharmaceutical tablets, may be found in U.S. Pat. No. 4,308,942, issued Jan. 5, 1982, and entitled "Single Drum Material Orientation Apparatus and Method". This apparatus, which is merely exemplary of this general class of apparatus, makes use of a single rotating drum which is capable of receiving tablets to be imprinted, for orientation and eventual delivery to a conveyor which is capable of drawing the tablets received beneath a printing apparatus. While such devices have proved to be effective in applying indicia to tablets and the like, it has been found that such devices are capable of still further improvement.

For example, it is to be noted that such devices are capable of applying indicia to only one side (or face) of the tablets being processed. Thus, if it becomes necessary to apply indicia to a second face of the tablets being processed, it generally becomes necessary to perform a second, discrete printing operation. This is clearly undesirable in view of cost, and the considerations of time. Moreover, the additional procedures required tend to introduce an additional potential for error into the processing operation, leading to an increase in rejection rate, and accordingly, a decrease in overall efficiency.

Attempts have been made to develop devices which are capable of simultaneously applying indicia to more than one face of a series of articles being processed. An example of one such device may be found in U.S. Pat. No. 3,272,118, entitled "Article Marking Machine". This apparatus incorporates a generally downwardly sloping conveyor for receiving a series of articles from a feed hopper, and for conveying the series of articles received between an opposing pair of printing mechanisms. As the articles are drawn between the opposing pair of printing mechanisms provided, desired indicia are simultaneously applied to each face of the series of articles being processed. However, this apparatus has been found to be less than satisfactory in actual operation.

For example, it will be noted that such an apparatus provides no means for assuring that the articles being processed are appropriately transferred from the feed hopper to the conveyor of the apparatus. For this reason, it is not uncommon for the holders which are drawn through the feed hopper to leave the feed hopper without receiving an article to be imprinted, decreasing the overall efficiency of the apparatus.

Moreover, two-sided printing is accomplished by means of opposed printing mechanisms which must simultaneously contact the series of articles being processed. This presents a significant disadvantage in that proper adjustment of the printing process necessitates a relatively complicated interactive adjustment wherein the location of each printing mechanism is adjusted in relation to the other printing mechanism provided, as well as the series of holders passing between the opposing pair of printing mechanisms.

Also to be considered are the significant difficulties which are encountered when it becomes necessary to change the apparatus over, from the printing of a first type of article to the printing of a second type of article. It will be understood that such a procedure is not possible without dismantling significant portions of the apparatus, to replace the series of holders then in use with a different series of holders adapted to receive the new type of article to be processed. Thereafter, it becomes necessary to readjust the printing mechanisms as previously described. Clearly, these procedures are undersirable, often to the point of precluding the convenient use of such an apparatus to imprint several different types of articles.

It therefore remained desirable to develop an apparatus which is capable of applying indicia to more than one side (or face) of a series of articles, which is convenient to operate, and which does not exhibit the foregoing disadvantages.

SUMMARY OF THE INVENTION

It is therefore a principal object of the present invention to provide an apparatus for apolying indicia to more than one side of a given article in a single processing operation.

It is also an object of the present invention to provide an apparatus for applying indicia to more than one side of an article in a single processing operation, which exhibits improved versatility in its operation.

It is also an object of the present invention to provide an apparatus for applying indicia to more than one side of an article in a single processing operation, which is easy to both set-up and operate.

It is also an object of the present invention to provide an apparatus for applying indicia to more than one side of an article in a single processing operation, which is readily adaptable to the application of indicia to various different types of articles with a minimum amount of changeover and readjustment.

It is also an object of the present invention to provide an apparatus for applying indicia to more than one side of an article in a single processing operation, which exhibits improved efficiency in the handling of those articles being imprinted.

These and other objects which will become apparent are achieved in accordance with the present invention by providing an article marking apparatus which generally includes a transfer drum for receiving a series of articles from a feed hopper, for transfer to a conveyor system in simplified fashion, and a pair of printing heads associated with the article marking apparatus at different locations along the path through which the articles progress, which locations are selected so that the articles being processed are capable of sequentially receiving desired indicia on more than one side.

In a preferred embodiment of the present invention, a first printing head is positioned along the arcuate transfer path developed as the articles progress about the transfer drum, while a second printing head is positioned along the conveyor system. In this manner, the first printing head is capable of applying indicia to a first side of the articles being processed as they traverse the transfer drum. As the articles are passed from the transfer drum to the conveyor system, the imprinted side of each article is placed on the conveyor system so that the applied indicia face downwardly, exposing the remaining side of the article for imprinting by means of the second printing head. In this fashion, indicia are capable of being applied to both sides of the articles being processed in a single processing operation. Moreover, such benefits are obtainable in connection with a transfer apparatus which has previously proven to be highly versatile and efficient in connection with the processing of articles of the present type.

Further in accordance with the present invention, the article marking apparatus is provided with additional features which still further improve its versatility. For example, while the foregoing apparatus is capable of applying indicia to both sides of a series of articles in a single processing operation, it is also capable of only applying indicia to either side of the articles being processed, since the printing heads provided are capable of separate activation and deactivation in accordance with a particular need. Since the printing heads are positioned at different locations along the path of movement of the articles being processed, this can be accomplished without having to readjust the remaining printing head, which merely proceeds to operate in its usual fashion.

Further in accordance with the present invention, the article marking apparatus is well suited to the application of indicia to a variety of different types of articles, with a minimum amount of set-up and readjustment. To this end, the face of the transfer drum is provided with a series of laterally spaced rows of article receiving cavities, as is conventional in this art. However, in accordance with the present invention, individual rows or groupings of rows are provided with differently configured article receiving cavities, so as to be capable of processing different types of articles. Selection of the rows or groupings of rows which are to be called into operation, and accordingly, the type of articles which are to be processed, is accomplished in accordance with the present invention by the movement of a vacuum shoe along the inner face of the transfer drum so that the vacuum shoe is brought into alignment with those rows of article receiving cavities which are to be called into operation. The only other operation which may be required to assure the proper application of indicia to a desired series of articles is to readjust the rollers of the printing heads which are to be used, in conventional fashion. Thus, the article marking apparatus of the present invention is capable of being made ready for the processing of different types of articles in an extremely simple and straightforward manner not previously possible.

Further improvements provided by the article marking apparatus of the present invention, as well as a detailed description of a preferred embodiment article marking apparatus, are set forth in the following detailed description, taken in conjunction with the following illustrations.

BRIEF DESCRIPTION OF THE DRAWINGS

In the several views provided, like reference numerals denote similar structure.

DETAILED DESCRIPTION OF A PREFERRED EMBODIMENT

Figure 1:
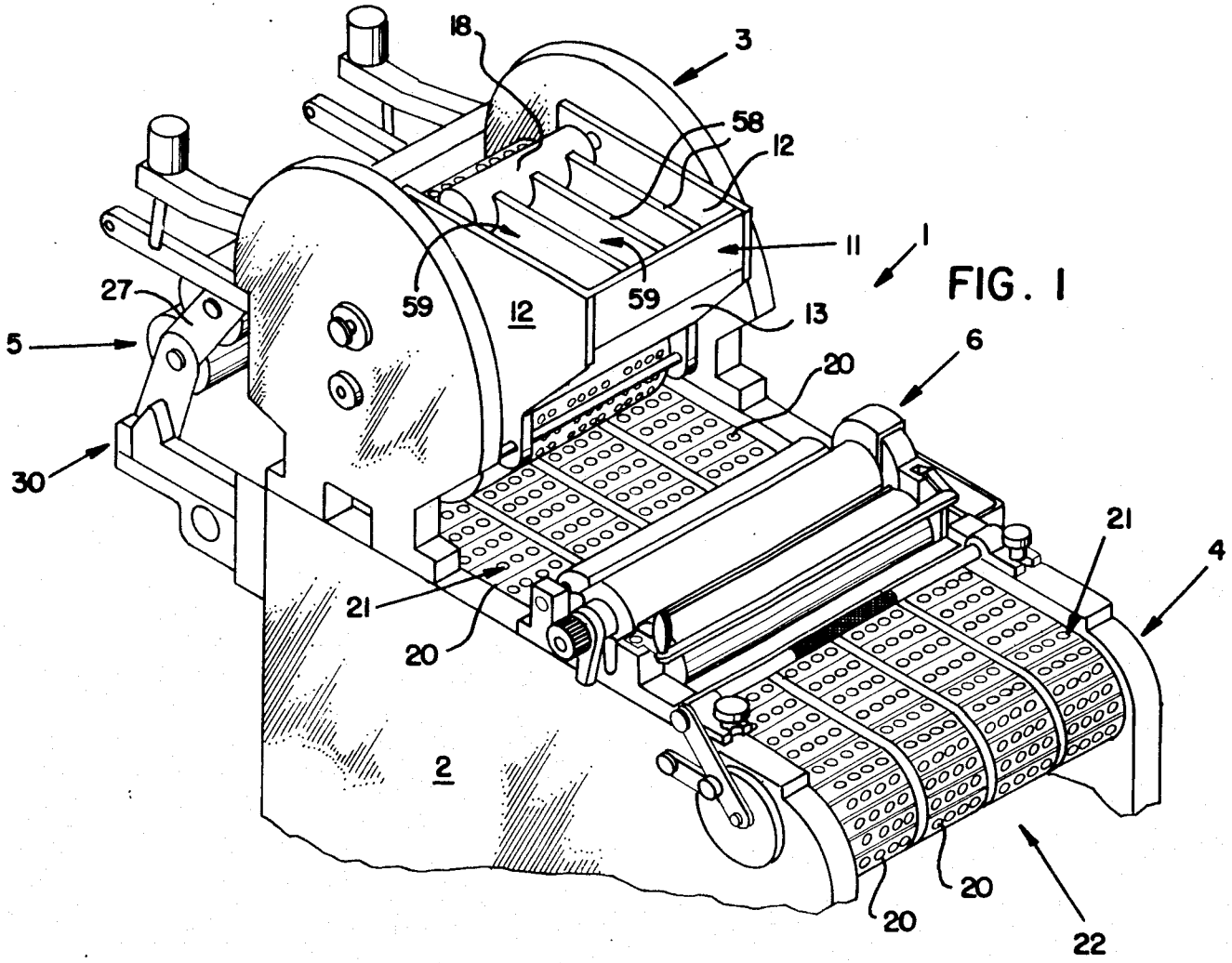
FIG. 1 is a perspective view of an article marking apparatus in accordance with the present invention.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 generally illustrates a preferred embodiment article marking apparatus 1 produced in accordance with the present invention. The apparatus 1 generally comprises a frame 2 upon which is positioned a transfer assembly 3, and within which is positioned a conveyor assembly 4. Operatively associated with the apparatus 1 are a pair of printing heads 5, 6. The printing head 5 is operatively associated with the transfer assembly 3, while the printing head 6 is operatively associated with the conveyor assembly 4.

As will be apparent from the description which follows, the apparatus 1 is capable of proceeding in appropriate fashion to process a desired batch or series of articles. It will be understood that any of a number of different types of articles may be processed by the apparatus 1 including candies, pharmaceutical tablets, caplets or the like, or other types of pellets, as desired. However, for the purposes of description, the apparatus 1 illustrated in the drawings and described below is shown in a configuration which is suited to the processing of pharmaceutical tablets 10 having opposing faces 8,9.

Figure 2A:
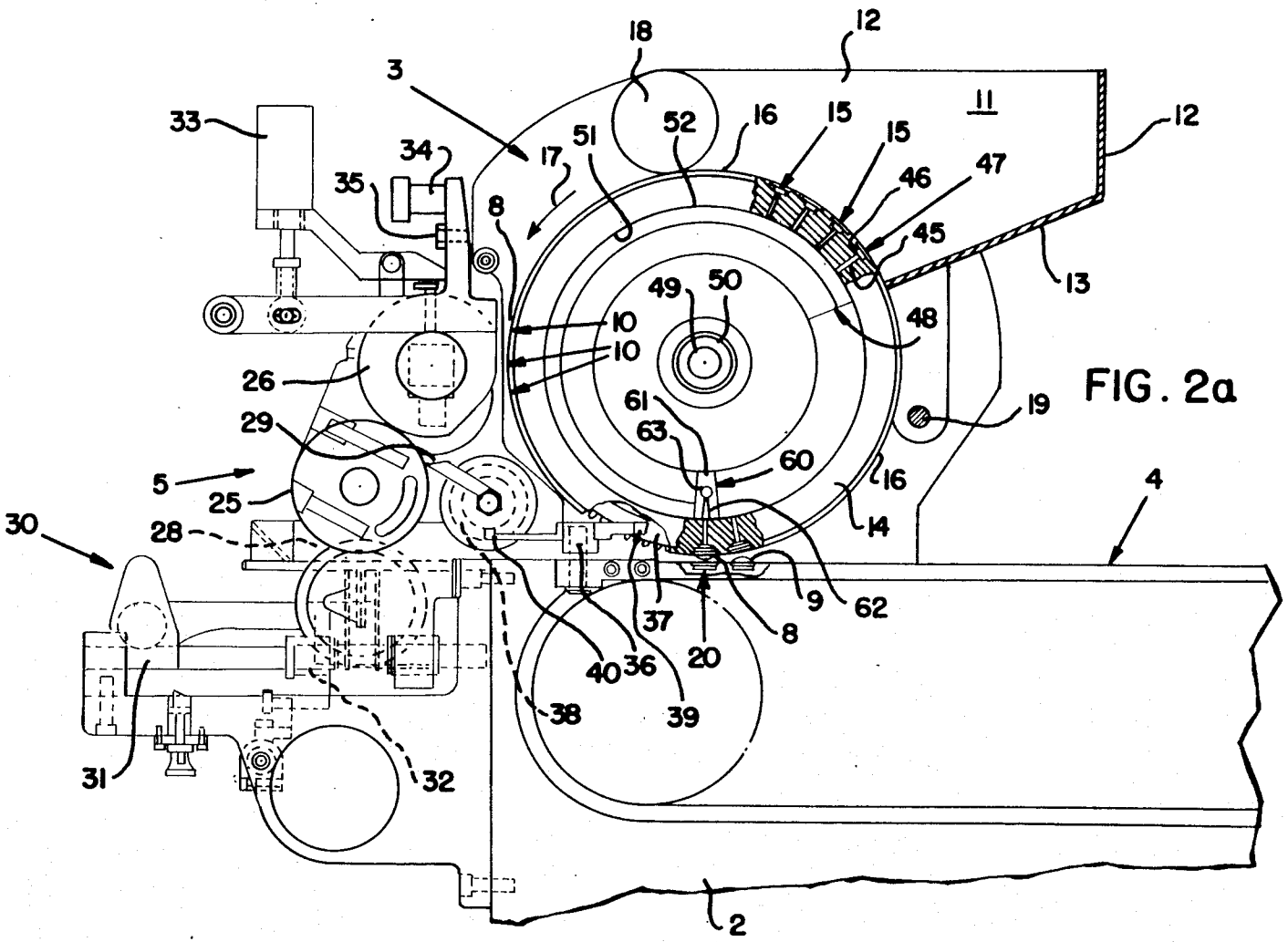
FIGS. 2*a* and 2*b* are schematic, sectional views of the apparatus illustrated in FIG. 1.
Figure 2B:
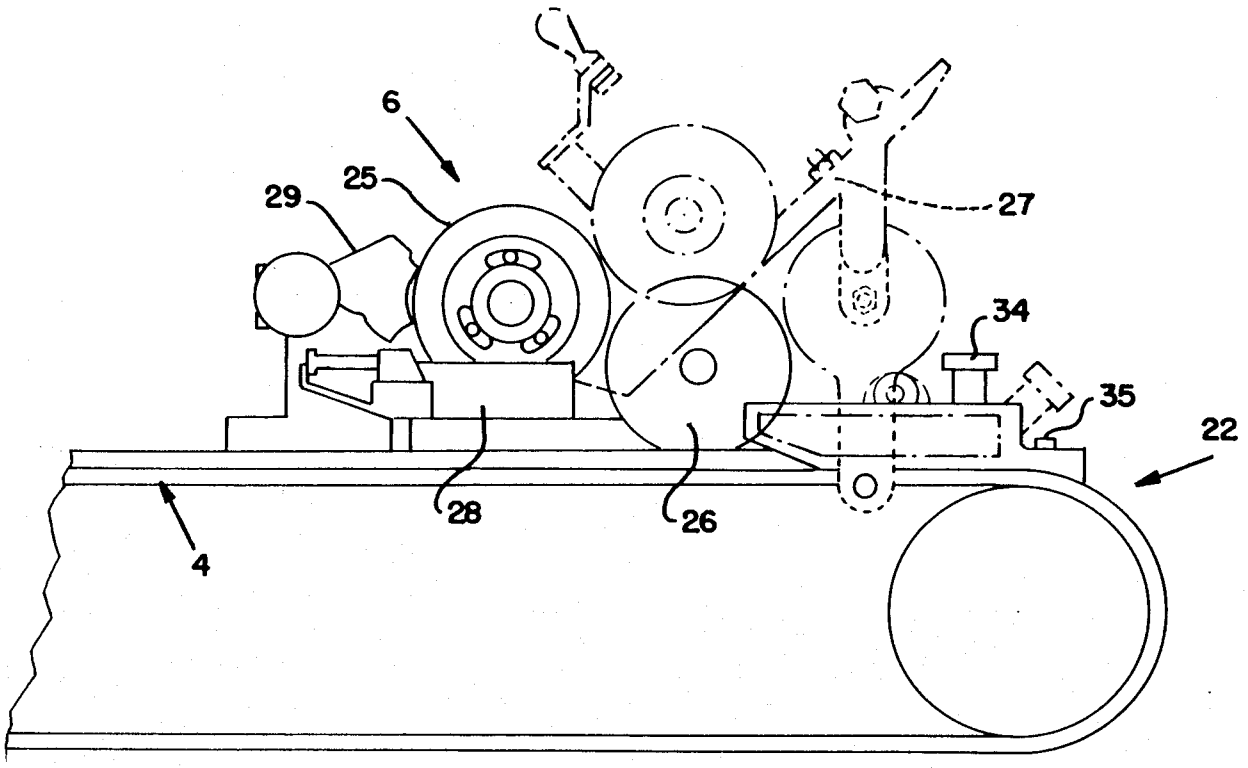

In operation, a quantity of such tablets 10 are placed within a feed hopper 11 which is located along upper portions of the transfer assembly 3. The feed hopper 11 generally includes side walls 12 and a sloping bottom 13 for containing the series of tablets 10 received, and for directing the series of tablets 10 toward a transfer drum 14 which is disposed for rotation within the transfer assembly 3, as is best illustrated in FIG. 2. In this fashion, tablets 10 are capable of being received from the feed hopper 11 in a series of tablet receiving cavities 15 formed in the outer surface 16 of the transfer drum 14. Tablets 10 received in the cavities 15 are transferred from beneath the feed hopper 11, in the direction of arrow 17, passing a rotating brush 18 which assists in properly seating the tablets 10 within the cavities 15 for subsequent processing. As will be described more fully below, a vacuum is applied at the base of each cavity 15 to further assist in seating and retaining the tablets within the cavities 15 of the transfer drum 14. As a further convenience, the feed hopper 11 is adapted for displacement about the pivot 19, for access to the transfer drum 14, and for cleaning purposes.

The tablets 10 received within the cavities 15 of the transfer drum 14 are then caused to pass beneath the first printing head 5 so as to receive desired indicia on the exposed face 8 of each tablet 10. The vacuum applied at the base of each cavity 15 serves to assure proper seating of the tablets 10 within the cavities 15 as this first printing step takes place.

The tablets 10 are thereafter brought to the conveyor assembly 4, at which time the tablets 10 are transferred from the cavities 15 of the transfer drum 14 to a series of pockets 20, which are formed in a series of carriers 21 comprising the conveyor assembly 4, and which are brought into registration with the cavities 15 of the transfer drum 14 as a result of synchronized operation of the transfer drum 14 and the conveyor assembly 4. It will be noted that in this transition, the tablets 10 are received on the conveyor assembly 4 such that the faces 8 which were exposed in traversing the transfer drum 14 now face downwardly, thereby exposing the other faces 9 of the tablets 10 for processing.

The tablets 10 are then drawn by the conveyor assembly 4 beneath the second printing head 6 so as to receive desired indicia on the now exposed faces 9 of the tablets 10, completing the printing procedure. Thereafter, the tablets 10 are discharged from the conveyor assembly 4 at the terminating end 22 of the conveyor, for subsequent handling.

Each of the printing heads 5, 6 generally comprises a design roll 25 and a print roll 26 which extend between a pair of end plates 27. The design roll 25 and the print roll 26 are journalled for rotation within the end plates 27 in parallel axial alignment with one another. As is conventional, the surface of the design roll 25 is provided with desired patterns for transfer to the articles being imprinted. These patterns are drawn through an ink pan 28 to take up ink on the surface of the design roll 25. Excess ink is wiped from the surface of the design roll 25 by means of a doctor blade 29. The print roll 26 then contacts the design roll 25, receiving the ink from the patterns on the design roll 25 for eventual transfer to one of the surfaces 8, 9 of the series of tablets 10 being processed. Suitable adjustments are provided to assure proper contact between these various elements.

To assist in servicing of the printing heads 5, 6, the design roll 25 and print roll 26 are retained within the end plates 27 such that the print roll 26 is capable of being lifted away from the series of tablets 10 being processed, while maintaining tangential contact with the design roll 25. This allows servicing of the printing heads 5, 6, such as the replenishing of ink in the ink pan 28, in simplified fashion and without requiring readjustment of the printing head 5, 6 after the desired servicing operation has been carried out. Further detail regarding the construction of such an assembly may be found in U.S. patent application Ser. No. 544,509, the subject matter of which is incorporated by reference as if fully set forth herein.

The printing head 5 which is associated with the transfer assembly 3 is further provided with a carriage assembly 30 which further assists in servicing of the printing head 5. This carriage assembly 30 generally comprises a pair of guides 31 which extend from the frame 2 of the apparatus as shown. The guides 31 are received within a pair of bushings 32 formed in the end plates 27 of the printing head 5. In this manner, the printing head 5 is capable of being drawn along the guides 31 between a first position in which the print roll 26 is in an operative position, and a second position in which the print roll 26 is retracted to a servicing position. In the operative position, the print roll 26 is capable of being brought into contact with the series of tablets 10 being processed, for imprinting, or is capable of being retained away from the tablets 10 being processed if imprinting of the faces 8 of the tablets 10 is not desired, by means of the air cylinders 33. In the servicing position, the print roll 26 is capable of being rotated with respect to the design roll 25, to gain access to the ink pan 28, and for other servicing operations to take place. The printing head 6 which is associated with the conveyor assembly 4 is caused to assume operative and standby positions, as desired, simply by rotating the print roll 26 about the design roll 25. In either case, it will be noted that tangential contact is maintained between the design roll 25 and the print roll 26 throughout these procedures, serving to eliminate the need for readjustment of these components as different modes of operation of the printing heads 5, 6 are called into play.

Both the printing head 5 and the printing head 6 are capable of being secured in their operative positions by means of a pair of thumb screws 34. Adjustment of the spacing between the print roll 26 and the transfer drum 14 (in the case of the printing head 5) and the conveyor assembly 4 (in the case of the printing head 6) is provided by means of set screws 35.

Irrespective of whether the printing heads 5, 6 are in an operative position or a standby/servicing position, it is desirable to maintain rotation of the design rolls 25 and the print rolls 26 while the apparatus 1 is in operation, to maintain synchronization with the transfer assembly 3 and the conveyor assembly 4. This is important to maintain proper registration between the patterns to be transferred from the printing heads 5, 6 and the series of tablets 10 which are being processed by the apparatus 1. To this end, both the printing head 5 and the printing head 6 are provided with power take-offs which assure continued rotation of the design rolls 25 and the print rolls 26 irrespective of their positioning with respect to each other, as well as their positioning with respect to the transfer assembly 3 or the conveyor assembly 4. To be noted is that the power take-off for the printing head 5 is configured to maintain rotation of the design roll 25 and print roll 26, even when the printing head 5 is retacted to its servicing position.

Also to be considered is that it is generally desirable for contact between the doctor blade 29 and the design roll 25 to undergo a lateral reciprocation which gives rise to a sweeping pattern. This is generally accomplished by providing the doctor blade 29 with a mechanism which laterally reciprocates the doctor blade 29 within the end plates 27 to develop the desired sweeping motion. Reciprocation of the doctor blade 29 of the printing head 6 is accomplished in conventional fashion. However, special consideration must be given to the doctor blade 29 of the printing head 5 since the printing head 5 is adapted for movement along the guides 31. To this end, a lever 36 is provided which extends between a cam 37 operatively associated with the gearing which rotates the transfer drum 14, and a follower 38 connected to the end of the doctor blade 29. Rotation of the transfer drum 14 causes one end 39 of the lever 36 to travel within the cam 37 such that the opposite end 40 of the lever 36 causes reciprocation of the follower 38. To accommodate movement of the printing head 5 along the guides 31, the follower 38 is capable of being drawn along the end 40 of the lever 36 to maintain reciprocation of the doctor blade 29 irrespective of the position of the printing head 5 with respect to the transfer assembly 3 of the apparatus 1.

As previously indicated, the tablets 10 are caused to traverse the transfer assembly 3 with the assistance of a vacuum applied at the bases of the several cavities 15 formed in the outer surface 16 of the transfer drum 14. To this end, and as is best illustrated in FIG. 2, each of the cavities 15 is provided with a channel 45 in its base 46 which extends between the cavity 15 and the interior 47 of the transfer drum 14. The interior 47 of the transfer drum 14, which is hollow and generally cylindrical, receives a vacuum head 48 such that the center hub 49 of the transfer drum 14 engages a centrally disposed bearing 50 formed in the vacuum head 48, and such that the peripheral surface 51 of the vacuum head 48 is in sliding contact with the inner surface 52 of the transfer drum 14.

Figure 3:
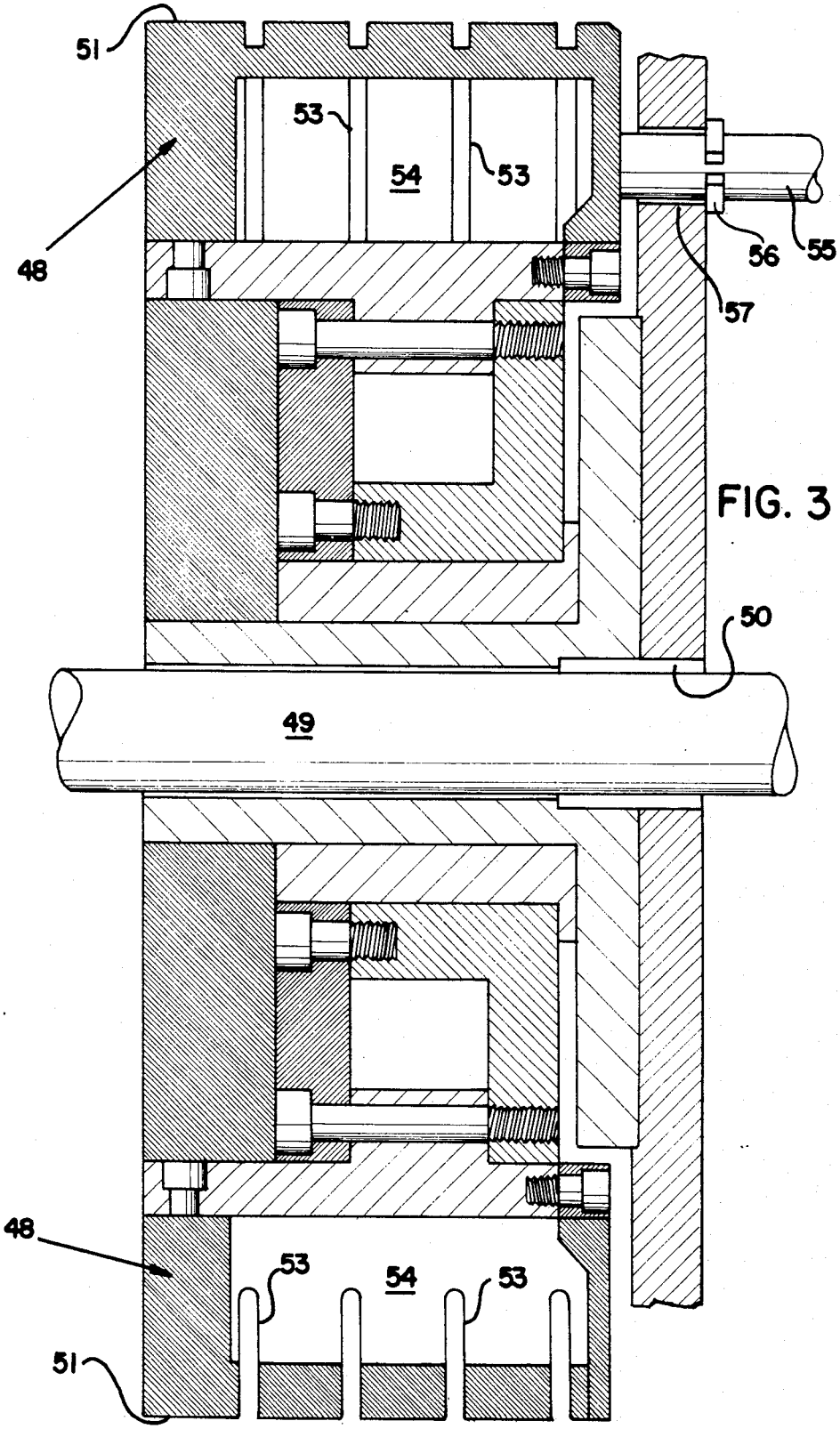
FIG. 3 is a sectional view of the apparatus illustrated in FIG. 2, taken along line 3—3.

The peripheral surface 51 of the vacuum head 48 is provided with a series of slots 53 spaced circumferentially along the surface 51. It will, of course, be understood that the several slots 53 are in some fashion bridged at appropriate locations to maintain the integrity of the peripheral surface 51 across its length. The several slots 53 are located along the peripheral surface 51 of the vacuum head 48 such that each of the slots 53 is capable of being brought into registration with those channels 45 which communicate with a circumferential row of the cavities 15 which are formed in the transfer drum 14. In this fashion, a vacuum is capable of being applied to the several channels 45 of a row of cavities 15 through each of the several slots 53 provided. Such a vacuum is developed within a vacuum chamber 54 which extends about the vacuum head 48, as is best illustrated in FIGS. 2 and 3. Vacuum is applied to the vacuum chamber 54 by means of a vacuum hose 55 which communicates with the vacuum head 48 at the fitting 56.

It will be noted that the vacuum head 48 illustrated in FIG. 3 extends across only portions of the inner surface 52 of the transfer drum 14, and that in the embodiment illustrated, only four of the rows of cavities 15 which are formed in the outer surface 16 of the transfer drum 14 are capable of receiving a vacuum from the vacuum head 48. It will therefore be understood that only these four rows of cavities 15 will be fully operative in processing a series of tablets 10. Accordingly, by sliding the vacuum head 48 along the hub 49, it is possible to selectively activate different series of cavities 15 formed in the outer surface 16 of the transfer drum 14, thus allowing the selection of those cavities 15 which are to be used in processing tablets 10. Retaining the vacuum head 48 in the lateral position selected is readily accomplished by securing the fitting 56 and/or vacuum hose 55 to the end plate 27 of the transfer assembly 3, for example, at the elongated aperture 57 through which the fitting 56 and/or vacuum hose 55 passes to the exterior of the apparatus.

Figure 4:
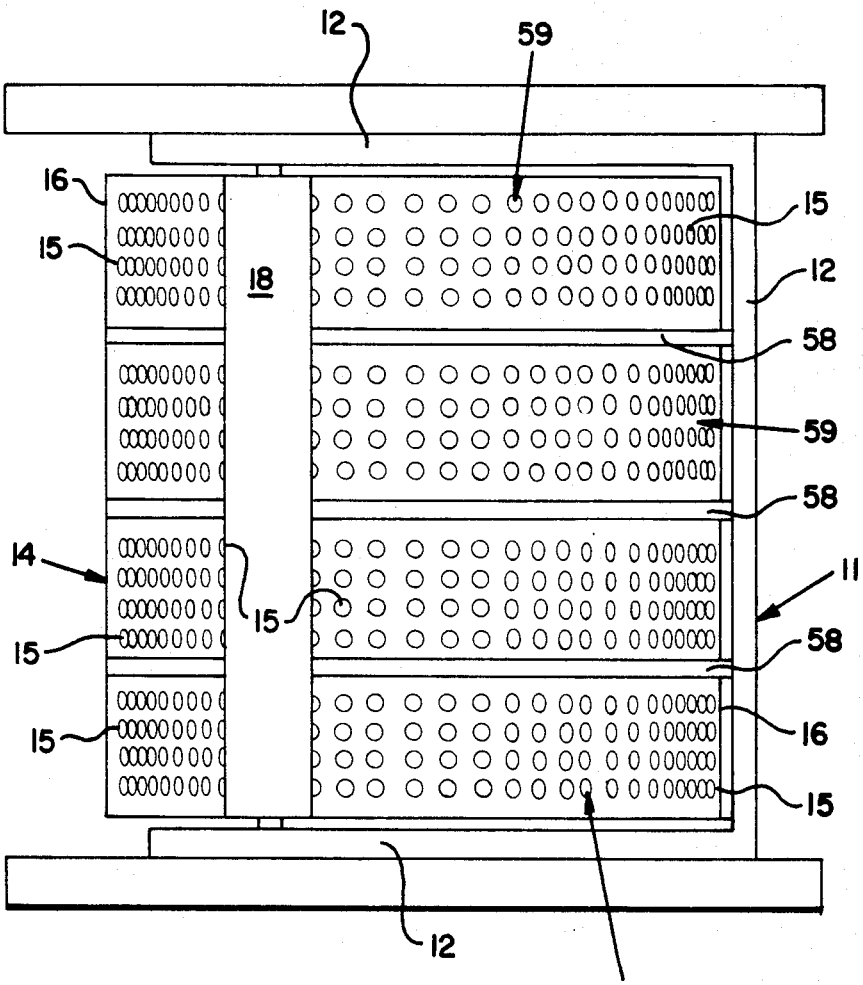
FIG. 4 is a partial, top plan view of the apparatus illustrated in FIG. 1.

By providing the outer surface 16 of the transfer drum 14 with cavities 15 of different configuration, it becomes possible to process different types of tablets 10 simply by varying the position of the vacuum head 48 along the hub 49, providing a simplified means for changing over the apparatus 1 to the printing of different types of tablets. Referring to FIG. 4, it will be noted that the feed hopper 11 is provided with a series of partitions 58 which separate the feed hopper 11 into separate compartments 59. It will be understood that tablets of a selected type will be placed within the appropriate compartment 59 for that type of tablet, and that the vacuum head 48 will be placed in proper alignment with the desired compartment 59, to enable processing of the type of tablet selected. The remaining compartments 59 will remain empty, since the cavities 15 passing beneath such compartments will be deactivated by virture of the positioning of the vacuum head 48.

It will of course be understood that the embodiment selected for illustration in the drawings merely exemplifies any of a number of embodiments which may be developed in accordance with the present invention. For example, while four groups of four parallel rows of cavities 15 are developed in the illustrative example, it will be understood that more or fewer groups of rows may be used. It is even possible for all rows of the transfer drum 14 to be simultaneously activated if it is desired to process only a single type of tablet, or if it is desired to simultaneously process several different types of tablets. This would be accomplished by providing a vacuum head 48 having slots 53 in registration with each of the rows of cavities 15 formed in the transfer drum 14. In the event that discrete groupings of rows are utilized, it will be understood that more or fewer rows per grouping may be provided if desired. In any event, the configuration of the compartments 59 would be correspondingly varied.

Irrespective of the peripheral characteristics of the vacuum head selected for use in a particular application, it will be noted with reference to FIG. 2, that the vacuum head 48 is maintained in peripheral contact with the inner surface 52 of the transfer drum 14. In the embodiment illustrated in the drawings, this contact is maintained over approximately 270°, extending continuously between the point where the transfer drum 14 is brought beneath the feed hopper 11 and the point at which the tablets 10 are delivered from the transfer assembly 3 to the conveyor assembly 4. This assures that an appropriate vacuum is maintained as the tablets 10 traverse the transfer drum 14. At the location where the tablets 10 are to be delivered from the transfer assembly 3 to the conveyor assembly 4, the vacuum is discontinued, and an air jet 60 is provided in the end plate 61 of the vacuum head 48 which is positioned along lower portions of the transfer assembly 3. To this end, the end plate 61 is provided with a hollow center 62 which receives compressed air from an external line 63. One such air jet 60 is placed in alignment with each of the slots 53 formed in the vacuum head 48. The resulting air jets 60 serve to assure that tablets 10 are effectively discharged from the drum 14, to the carriers 21 of the conveyor assembly 4 for subsequent processing.

It will be understood that to accommodate various applications and timing considerations, it is preferable to provide a vacuum head 48 which is circumferentially, as well as laterally adjustable. This is readily accomplished by rotating the vacuum head 48 about the hub 49, and by again securing the vacuum head 48 in desired position along the elongated slot 57 which receives the fitting 56 and/or the vacuum hose 55. In addition to this adjustment, it will also be understood that the degree to which the vacuum head 48 proceeds about the interior 47 of the transfer drum 14 is also capable of variation, depending, for example, upon the location of the feed hopper 11 and the conveyor assembly 4 with respect to the transfer assembly 3.

To further assist in the effective transfer of tablets 10 from the feed hopper 11 though the remainder of the apparatus 1, both the cavities 15 of the transfer drum 14 and the pockets 20 of the conveyor assembly 4 are configured so that they are not only well suited to the processing of different types of tablets 10, but so that they also facilitate the proper positioning of such tablets 10 within the cavities 15 of the transfer drum 14 and the pockets 20 of the carriers 21. In particular, each of the cavities 15 and the pockets 20 are preferably provided with a means for directing a tablet 10 to be processed along either the surface 16 of the transfer drum 14, or the surface 64 of a carrier 21, and into one of the cavities 15 or the pockets 20, respectively. In each case, the means used to facilitate such placement of the tablets 10 within the cavities 15 and pockets 20 generally comprises sloped surface portions which gradually extend between the surface 16 of the transfer drum 14 and the walls defining one of the cavities 15, and between the surface 64 of the carrier 21 and the walls defining one of the pockets 20. Further detail regarding such tablet feeding means may be found in U.S. patent application Ser. No. 395,926, the subject matter of which is incorporated by reference as if fully set forth herein.

As previously indicated, the apparatus 1 of the present invention is particularly well suited to the processing of different types of tablets, and accordingly, incorporates different types of tablet receiving cavities 15 and pockets 20. To facilitate such processing, these cavities 15, and their corresponding pockets 20, are provided with appropriately sloped surface portions which serve as a means for assuring that the tablets 10 being processed are effectively placed within the tablet receiving cavities 15 and pockets 20 provided.

Figure 5:
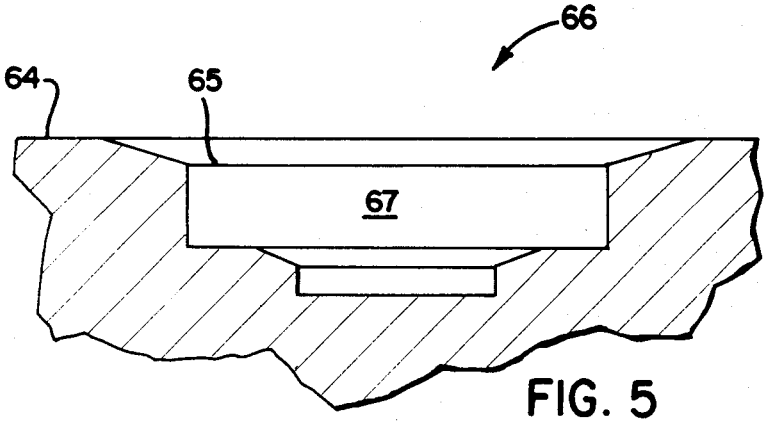
FIG. 5 is a sectional view of an alternative embodiment tablet receiving cavity formed in the transfer drum of the article marking apparatus.

FIG. 5 illustrates a first alternative embodiment tablet receiving cavity 66. The corresponding tablet receiving pocket would be similarly shaped. In this embodiment, the cavity 66 incorporates a sloping surface 65 which uniformly and gradually extends between the surface 16 of the transfer drum 14 and the tablet receiving region 67 of the cavity 66. The shape of the region 67 is generally conformed to the shape of the tablet 10 to be received. It will be noted that the sloping surface 65 uniformly extends about the periphery of the region 67, and forms an acute included angle which is preferably on the order of 150°. This gradual transition between the surface 16 of the transfer drum 14 and the region 67 of the cavity 66 is developed by providing a sloping surface 65 which has significant length in relation to the size of the tablet 10 being processed, as distinguished from merely providing the periphery of the cavity 66 with a chamfer, as is conventional in this art.

Figure 6:
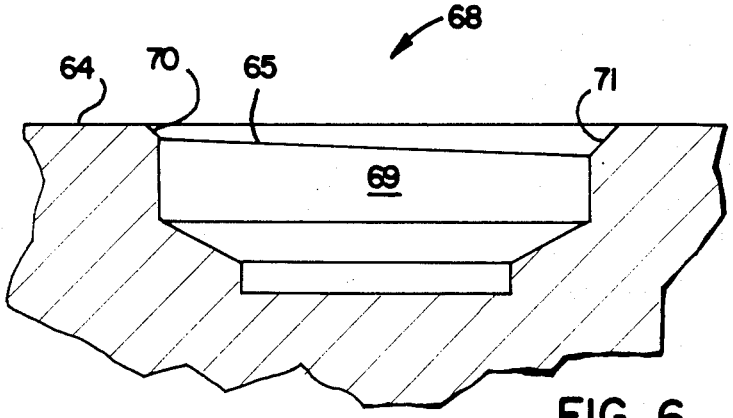
FIG. 6 is a sectional view of another alternative embodiment tablet receiving cavity.

FIG. 6 illustrates a second alternative embodiment cavity 68, which again incorporates a sloping surface 65 extending between the surface 16 of the transfer drum 14 and the tablet receiving region 69 of the cavity 68. Again, the corresponding tablet receiving pocket would be similarly shaped. However, in this embodiment, it will be noted that the sloping surface 65 is skewed in relation to the cavity 68, such that the sloping surface associated with the leading edge 70 of the cavity 68 is somewhat smaller than the sloping surface associated with the trailing edge 71 of the cavity 68. Such a skewed configuration has been found to be advantageous in the handling of certain types of tablets 10.

Figure 7:
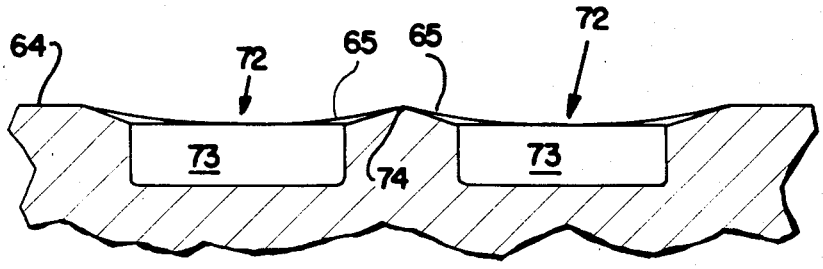
FIG. 7 is a sectional view of yet another alternative embodiment tablet receiving cavity.

FIG. 7 illustrates a third alternative embodiment cavity 72, the configuration of which is essentially similar to the cavity 66 illustrated in FIG. 5. However, it will be noted that the sloping surfaces 65 of adjacent cavities 72 are in contact with one another such that the cavities 72 run together along the surface 16 of the transfer drum 14 (or along the surface 64 of a carrier 21). Such a configuration has been found to be particularly advantageous in assuring that tablets 10 are delivered from the surface 16 of the transfer drum 14 to the region 73 of the cavity 72 as a result of the point contact which is developed at the apex 74 of the sloping surfaces 65 of adjoining cavities 72. Such point contact has been found to be particularly advantageous in jogging tablets 10 from the surfaces involved.

It will be understood that the cavities 66, 68, 72 (and corresponding pockets) illustrated in FIGS. 5–7 are merely illustrative of pockets which may be used in the processing of any of a number of different types of tablets 10. Accordingly, the configuration of the regions 67, 69, 73, as well as the cavities 66, 68, 72 (and the corresponding pockets) are clearly capable of variation to receive a desired type of tablet. Moreover, it is possible for such configurations to be provided in any desired pattern or combination along the surface 16 of the transfer drum 14 (as well as the surfaces 64 of the carriers 21) to develop desired groupings of tablet receiving rows as previously described.

It will therefore be seen that the foregoing apparatus serves well to achieve each of the objectives previously set forth. It will also be understood that the apparatus 1 previously described is capable of variation without departing from the spirit and scope of the present invention. Many of these variations have previously been discussed. Other variations will become apparent to workers skilled in the present art.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for applying indicia to pellet-shaped articles, comprising:

a feed hopper for containing a plurality of said articles;

drum means operatively associated with said feed hopper, for receiving articles from said feed hopper and for orienting said articles to receive said indicia;

conveyor means operatively associated with said drum means, for receiving said oriented articles from said drum means;

wherein the outer surface of said drum means includes a plurality of article receiving cavities which are radially grouped in circumferential rows spaced along the outer surface of said drum means such that different rows of said drum means are provided with different shaped cavites to receive different shaped articles therein;

wherein said drum means and said conveyor means combine to transport said articles along a transport path; and first and second printing means operatively associated with said apparatus at different locations along said transport path.

2. The apparatus of claim 1 wherein said first printing means applies indicia to a first portion of said articles, and said second printing means applies indicia to a second portion of said articles different from said first portion.

3. The apparatus of claim 2 wherein said first printing means is operatively associated with said drum means and said second printing means is operatively associated with said conveyor means.

4. The apparatus of claim 1 wherein said articles have more than one side, and wherein said first printing means is adapted to apply indicia to a first side of said articles and said second printing means is adapted to apply indicia to a second side of said articles.

5. The apparatus of claim 4 wherein the first side of said articles is exposed when received by said drum means, and the second side of said articles is exposed when received by said conveyor means.

6. The apparatus of claim 5 wherein said first printing means is operatively associated with portions of said transport path defined by said drum means, and said second printing means is operatively associated with portions of said transport path defined by said conveyor means.

7. The apparatus of claim 6 wherein the portions of said transport path which are defined by said drum means are arcuate.

8. The apparatus of claim 1 wherein said pellet-shaped articles are tablets.

9. The apparatus of claim 1 wherein said first and said second printing means comprise a print roll and a design roll in parallel axial alignment within an adjustable support frame so that adjustment of said support frame causes rotation of said print roll about said design roll while maintaining tangential contact between said print roll and said design roll during said rotation.

10. The apparatus of claim 9 wherein said print roll is rotatable between an operative position in which said print roll contacts said articles, and a standby position in which said print roll is spaced from said articles.

11. The apparatus of claim 10 wherein said first printing means and said second printing means are capable of individually assuming either the operative position or the standby position.

12. The apparatus of claim 10 wherein said first printing means is operatively associated with said drum means, and wherein said first printing means is further capable of assuming a servicing position in which said printing means is spaced from said drum means.

13. The apparatus of claim 12 wherein said first printing means is movable between said operative/standby position and said servicing position on guide means which slidingly engage said first printing means.

14. The apparatus of claim 10 wherein said print roll is movable between said operative position and said standby position responsive to air cylinder solenoid means.

15. The apparatus fo claim 1 wherein the rows of different shaped cavities are grouped according to shape across the surface of said drum means.

16. The apparatus of claim 15 wherein said feed hopper includes partition means for developing article receiving compartments in alignment with the grouped rows of shaped cavities.

17. The apparatus of claim 15 wherein said conveyor means comprises a plurality of carrier means having pockets spaced along their surface and in alignment with the rows of cavities formed in said drum means.

18. The apparatus of claim 17 wherein the pockets of said carrier means are correspondingly configured to the cavities of the drum means with which said pockets communicate.

19. The apparatus of claim 1 wherein said cavities include means for directing an article from the surface of said drum means and into said cavities, to seat said articles within said cavities.

20. The apparatus of claim 19 wherein said article directing means are gradually sloping surfaces extending between the surface of said drum means and said cavities.

21. The apparatus of claim 20 wherein said surfaces are sloped such that the included angle of said surfaces is about 150°.

22. The apparatus of claim 20 wherein said sloping surfaces extend fully and symmetrically around said cavities.

23. The apparatus of claim 20 wherein said sloping surfaces extend fully around said cavities, and are skewed such that the slope of the surface at one end of each cavity is different from the slope of the surface at the opposite end of the cavity.

24. The apparatus of claim 20 wherein the sloping surfaces of adjacent cavities run together.

25. The apparatus of claim 19 wherein said conveyor means comprises a plurality of carrier means having pockets spaced along their surface, and wherein said pockets also include means for directing an article from the surface of said carrier means and into said pockets.

26. The apparatus of claim 1, wherein said cavities incorporate means for applying a vacuum to said articles to seat said articles within said cavities.

27. The apparatus of claim 26 wherein said vacuum applying means are channels formed in the bottom of said cavities and in communication with a vacuum head positioned internally of said drum means.

28. The apparatus of claim 27 wherein the vacuum head is in sliding, vacuum sealing engagement with the inner surface of said drum means, thereby enabling rotation of said drum means relative to said vacuum head.

29. The apparatus of claim 28 wherein the surface of said vacuum head which is in engagement with said drum means incorporates at least one circumferential slot in alignment with a row of said cavities.

30. The apparatus of claim 29 wherein said vacuum head is laterally slidable relative to said drum means, so that said slot is selectively alignable with different circumferential rows of cavities formed in said drum means.

31. The apparatus of claim 30 wherein said vacuum head includes a plurality of slots and wherein said slots are selectively alignable with groups of rows of cavities having the same configuration.

32. The apparatus of claim 29 wherein said slot extends substantially continuously between the location at which articles are received from said feed hopper and the location at which articles are transferred from said drum means to said conveyor means.

33. The apparatus of claim 32 wherein the positioning of said slot is circumferentially adjustable.

34. The apparatus of claim 32 wherein an air jet is operatively associated with said vacuum head, in alignment with said slot, at the location at which articles are transferred from said drum means to said conveyor means.

35. An apparatus for applying indicia to pellet-shaped articles, comprising:

a feed hopper for containing a plurality of said articles;

drum means operatively associated with said feed hopper, for receiving articles from said feed hopper and for orienting said articles to receive said indicia, wherein said drum means includes an inner and an outer surface;

a plurality of cavities formed in the outer surface of said drum means, for receiving said articles therein, and in communication with the inner surface of said drum means, wherein said cavities are radially grouped in a plurality of circumferential rows spaced along the outer surface of said drum means; and a vacuum head in sliding, vacuum sealing engagement with the inner surface of said drum means and including at least one circumferential slot alignable with at least one row of said cavities;

wherein said vacuum head is laterally slidable relative to said drum means so that said slot is selectively alignable with different rows of said cavities.

36. The apparatus of claim 35 wherein the cavities of each row are correspondingly configured, and wherein the cavities of different rows are differently configured.

37. The apparatus of claim 36 wherein said vacuum head includes a plurality of slots and wherein said slots are selectively alignable with groups of rows of cavities having the same configuration.

38. The apparatus of claim 37 wherein said slot extends substantially continuously between the location at which articles are received from said feed hopper and the location at which articles are transferred from said drum means.

39. The apparatus of claim 38 wherein the positioning of said slot is circumferentially adjustable.

40. The apparatus of claim 38 wherein an air jet is operatively associated with said vacuum head, in alignment with said slot, at the location at which articles are transferred from said drum means.

* * * * *